US005338243A

United States Patent [19]

Kieves

[11] Patent Number: 5,338,243

[45] Date of Patent: Aug. 16, 1994

[54] THREE-DIMENSIONAL NON-LATEX BALLOON

[75] Inventor: Garry Kieves, Minneapolis, Minn.

[73] Assignee: Anagram International, Inc., Minneapolis, Minn.

[21] Appl. No.: 161,972

[22] Filed: Dec. 3, 1993

Related U.S. Application Data

[63] Continuation of Ser. No. 887,683, May 22, 1992, abandoned.

[51] Int. Cl.[5] ..... A63H 3/06; G09F 21/06

[52] U.S. Cl. ..... 446/220; 446/226; 40/214

[58] Field of Search ..... 446/220, 221, 222, 223, 446/224, 225, 226, 267, 396, 486, 487, 488, 490, 491; 40/212, 214, 577, 612

[56] References Cited

U.S. PATENT DOCUMENTS

| | | | |
|---|---|---|---|
| 1,567,132 | 12/1925 | Gill | 446/226 |
| 2,927,383 | 3/1960 | Longino | 446/221 X |
| 3,153,878 | 10/1964 | Smith, Jr. | 446/225 |
| 3,664,058 | 5/1972 | Brieske | 446/224 |
| 3,686,782 | 8/1972 | Erickson et al. | 40/212 X |
| 4,034,495 | 7/1977 | Lemelson | 446/220 X |
| 4,077,588 | 3/1978 | Hurst . | |
| 4,232,477 | 11/1980 | Lin | 446/220 X |
| 4,268,030 | 5/1981 | Richards | 446/226 X |
| 4,778,431 | 10/1988 | Dudley | 446/221 |
| 4,917,646 | 4/1990 | Kieves . | |
| 5,041,047 | 8/1991 | Casale | 446/220 |
| 5,108,339 | 4/1992 | Kieves . | |
| 5,117,344 | 5/1992 | Perez | 446/220 X |

FOREIGN PATENT DOCUMENTS

| | | | |
|---|---|---|---|
| 7900569 | 8/1979 | PCT Int'l Appl. | 446/220 |
| 896904 | 5/1962 | United Kingdom | 446/220 |

*Primary Examiner*—Robert A. Hafer
*Assistant Examiner*—D. Neal Muir
*Attorney, Agent, or Firm*—Allegretti & Witcoff, Ltd.

[57] ABSTRACT

A balloon product, including at least two sheets, has a background depiction on one sheet and a foreground depiction on the other. The foreground depiction has a complementary relationship to the background depiction so as to provide a three-dimensional animated image.

3 Claims, 1 Drawing Sheet

THREE-DIMENSIONAL NON-LATEX BALLOON

This application is a continuation application of Ser. No. 07/887,683, filed May 22, 1992 abandoned.

BACKGROUND OF THE INVENTION

The present invention relates generally to non-latex balloons and more particularly to a non-latex balloon having a decoration thereon.

Non-latex balloons, often referred to as metallized balloons, have been popular for many years. See, e.g., U.S. Pat. Nos. 4,077,588 and 4,917,646, the teachings of which are incorporated herein by reference. Typically one sheet of the non-latex balloon is printed with a colorful decoration, such as a character, design, message, or combination thereof. More recently, toy products have developed which include a combination of balloons or a combination of balloons and other structures, such as appendages. See, e.g., U.S. Pat. No. 4,778,431 and co-owned Ser. No. 07/571,089 filed Aug. 22, 1990 now U.S. Pat. No. 5,108,339 and entitled "Non-Latex Inflatable Toy", the teachings of which are also incorporated herein.

SUMMARY OF THE INVENTION

In a principal aspect, the present invention is a non-latex balloon including a background sheet and at least a first foreground sheet, heat-sealed in registered format. The background sheet carries a background depiction on at least one surface thereof. The foreground sheet carries a foreground depiction having a complementary relationship with the background depiction. The visual impression created by the balloon is a three-dimensional animated image.

It is thus an object of the present invention to provide an animated balloon product. Another object is to provide a balloon product having complementary background and foreground depictions, thereby creating a three-dimensional animated image.

These and other features, objects and advantages of the present invention are set forth or implicit in the following detailed description of certain preferred embodiments.

BRIEF DESCRIPTION OF THE DRAWING

Preferred embodiments of the present invention are described, in detail, with reference to the drawing wherein.

DETAILED DESCRIPTION OF PREFERRED EMBODIMENTS

Various preferred embodiments of the present invention are shown in FIGS. 1–4 as an animated balloon product 10. Animation is derived from the three-dimensional image presented by the balloon product 10 when viewed from at least one general direction, i.e., front or rear.

Figure 1:
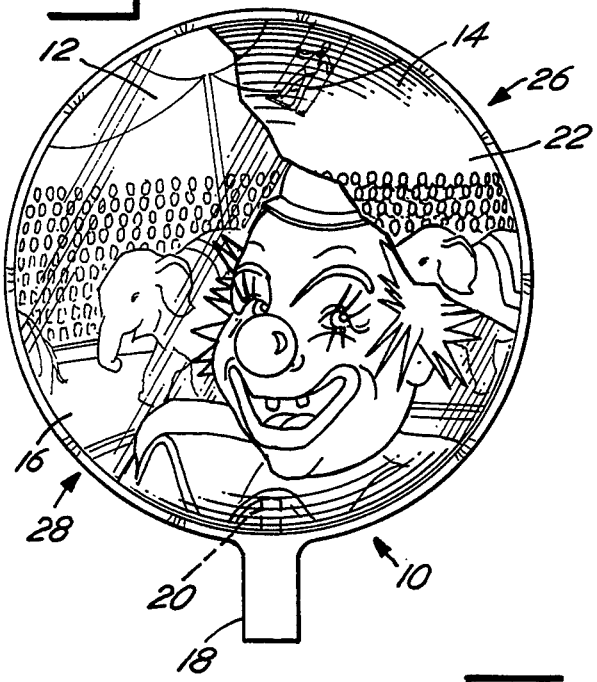
FIG. 1 is a front partially cut-away view of a first preferred embodiment of the present invention, including two balloon sheets, shown in the inflated state.
Figure 2:
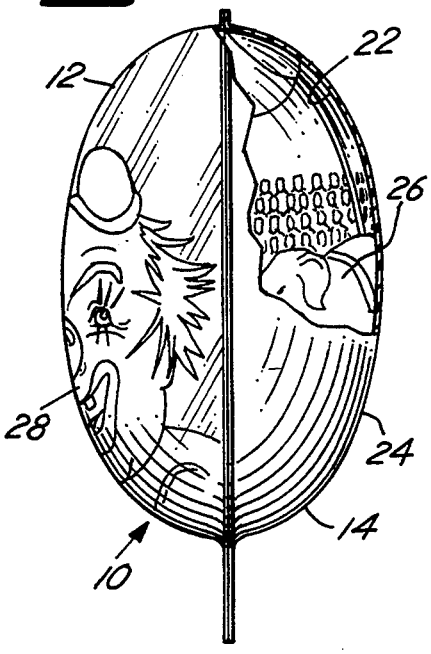
FIG. 2 is a side partially cut-away view of the balloon product shown in FIG. 1.

With reference to FIGS. 1 and 2, the balloon product 10 includes a front foreground sheet 12 and a background sheet 14, peripherally heat-sealed to define a balloon body 16 and stem 18. Preferably, a self-sealing valve 20 (shown in phantom in FIG. 1) is secured within the stem 18.

The background sheet 14 has a front surface 22 and a rear surface 24. Preferably the rear surface 24 is metallized in a conventional manner and the front surface 22 is printed with a front background depiction, typically scenery and generally designated 26.

The front foreground sheet 12 is preferably clear and printed with a foreground depiction, typical characters and generally designated 28. The foreground depiction 28 has a complementary relationship with the background depiction 26 and, when viewed from the front, presents a three-dimensional animated image.

Figure 3:
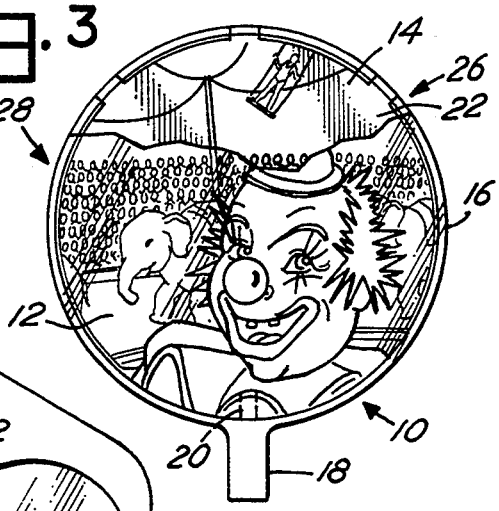
FIG. 3 is a front partially cut-away view of a second preferred embodiment, including three balloon sheets, shown in the inflated state.
Figure 4:
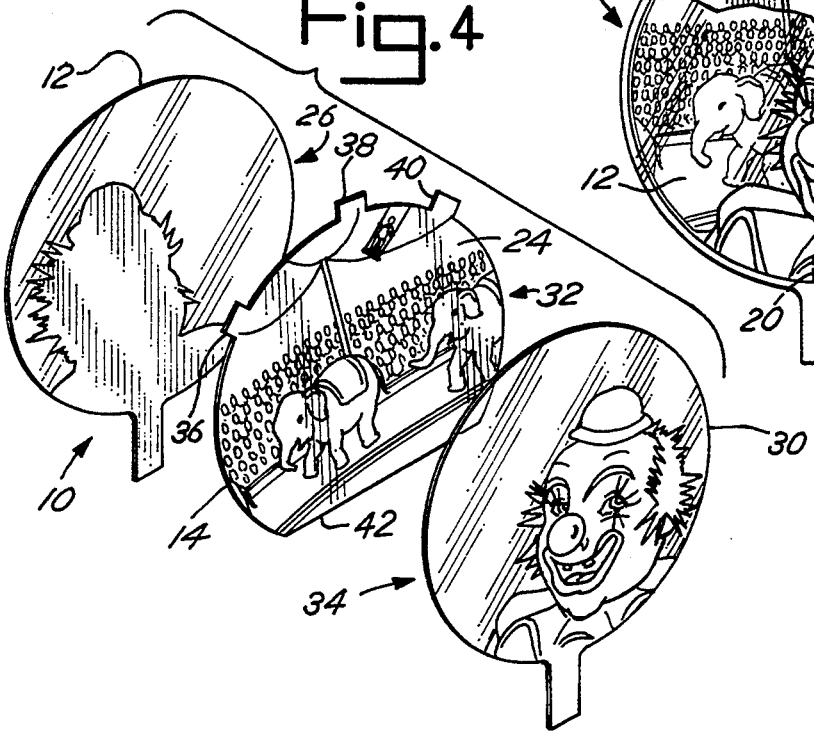
FIG. 4 is a rearward exploded perspective view of the balloon product of FIG. 3, shown in the deflated state.

Referring now to FIGS. 3 and 4, second and third preferred embodiments of the balloon product 10 include a second or rear foreground sheet 30. Here the first and second foreground sheets 12, 30 are peripherally heat-sealed to provide the balloon body 16 and stem 18, and the background sheet 14 is secured along at least a portion of this peripheral heat seal.

In the second preferred embodiment, the background sheet 14 is non-metallized, such that the background depiction 26 is visible from the front and rear directions. Alternatively, the rear surface 24 may be printed with a rear background depiction, shown in FIG. 4 and generally designated 32, which is similar to or distinctly different for the first and front background depiction 26. In either embodiment, the background sheet 14 may first be printed with a solid backdrop (not shown), such as white or black, to enhance the front or rear background depictions 26, 32.

The rear foreground sheet 30 is clear and printed with a rear foreground depiction, generally designated 34. This depiction 34 has a complementary relationship to the front or rear background depictions 26, 32, as the case may be, such that the balloon product 10 presents three-dimensional animated images from both front and rear directions.

Preferably, the background sheet 14 is heat-sealed between the first and second foreground sheets 12, 30 only in the region opposite the stem 18. This allows the background sheet 14 to hang in the inflated state and substantially avoids wrinkling thereof as the extent of the balloon body 16 decreases with inflation. As best shown in FIG. 4, the background sheet 14 is preferably trimmed during balloon manufacture to provide fastening projections 36, 38, 40 and to terminate along an edge 42, displaced from the stem 18 and having substantially horizontal orientation in the inflated, floating state. Trimming of the background sheet 14 in the area of the stem 18 facilitates automated insertion of the self-sealing valve 20.

Two preferred embodiments of the present invention have been described. It is to be understood, however, that changes and modifications may be made without departing from the true scope and spirit of this invention as defined by the following claims.

What is claimed is:

1. A non-latex balloon product having an inflated state comprising, in combination:

a substantially inelastic background sheet, substantially impermeable to a lighter-than-air gas, having an interior side and an exterior side with a coating providing a solid background and a printed background depiction on said interior side;

a substantially inelastic, substantially clear foreground sheet, substantially impermeable to a lighter-than-air gas and heat-sealed to said interior side of said background sheet to provide a balloon body and a balloon stem, said substantially inelastic, substantially clear foreground sheet displaying a printed foreground depiction having a complementary relationship with said background depiction to provide a three-dimensional animated image; and a self-sealing valve sealed within said balloon stem;

said background sheet having a substantially concave shape in said inflated state to substantially enhance said three-dimensional animated image.

2. A non-latex balloon product as claimed in claim 1 wherein said background sheet is metallized to provide said solid background.

3. A non-latex balloon product as claimed in claim 1 wherein said background sheet is printed to provide said solid background.

* * * * *